US007225709B2

(12) United States Patent
Liao

(10) Patent No.: US 7,225,709 B2
(45) Date of Patent: Jun. 5, 2007

(54) CONTROL DEVICE FOR CONNECTOR FOR SECURING SOCKET THEREON

(76) Inventor: I-He Liao, 11F-2 No. 43, Chai-I Street, Taichung City (TW)

( * ) Notice: Subject to any disclaimer, the term of this patent is extended or adjusted under 35 U.S.C. 154(b) by 184 days.

(21) Appl. No.: 11/068,021

(22) Filed: Feb. 28, 2005

(65) Prior Publication Data

US 2006/0193686 A1 Aug. 31, 2006

(51) Int. Cl.
*B25B 23/00* (2006.01)

(52) U.S. Cl. ..... 81/177.85; 81/177.2

(58) Field of Classification Search ..... 81/177.85, 81/177.2; 403/322.2, 322.3
See application file for complete search history.

(56) References Cited

U.S. PATENT DOCUMENTS 4,817,476 A * 4/1989 Karge ..... 81/177.85
5,090,275 A * 2/1992 McCann ..... 81/177.85
6,062,112 A * 5/2000 Bonniot ..... 81/177.85
6,209,208 B1 * 4/2001 Marinkovich et al. ..... 30/392
6,523,441 B2 * 2/2003 Lee ..... 81/177.85
6,840,142 B2 * 1/2005 Cheng ..... 81/177.85
2002/0189409 A1 * 12/2002 Lee ..... 81/177.85
2004/0089116 A1 * 5/2004 Cheng ..... 81/177.85
2004/0173060 A1 * 9/2004 Lee ..... 81/177.85

* cited by examiner

*Primary Examiner*—Debra Meislin
(74) *Attorney, Agent, or Firm*—Charles E. Baxley

(57) ABSTRACT

A connector for easily secure a socket thereon includes an axle rotatably received in an axial recess in an end of the connector and an inclined slot is defined radially in the body. A spring is biased between a first end of the axle and an inside of the axial recess. A guide portion such as a concavity with various depths is defined in a second end of the axle. A ball is movably engaged with a radial hole in the end of the body and operatively in contact with the concavity. A controller is rotatably mounted to the body and a pin extends through a hole in the controller and the inclined slot and is engaged with a receiving hole in the axle. The pin is automatically rotated backward by the spring when the user releases the controller.

3 Claims, 4 Drawing Sheets

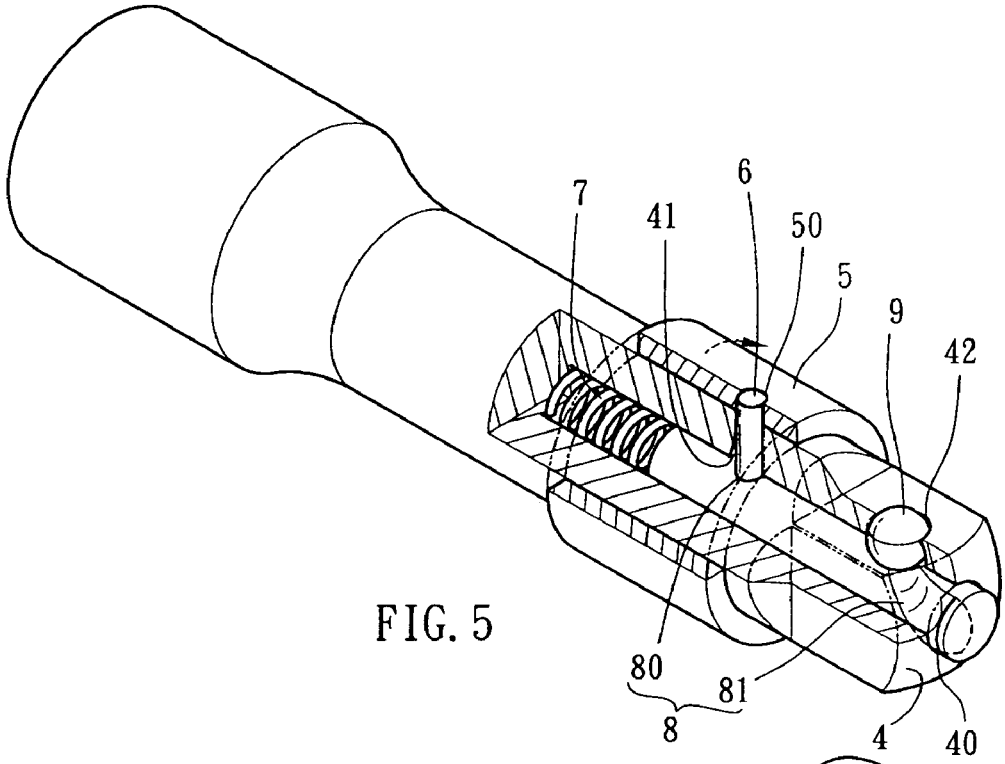
FIG. 5
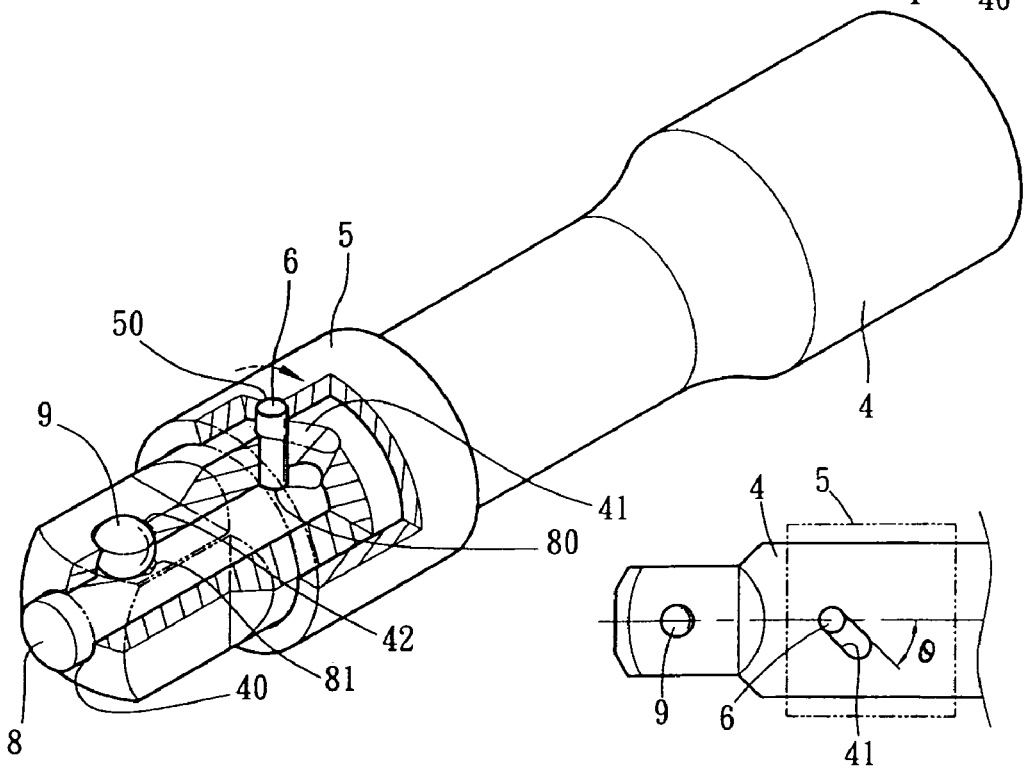
FIG. 6
FIG. 6-1

CONTROL DEVICE FOR CONNECTOR FOR SECURING SOCKET THEREON

FIELD OF THE INVENTION

The present invention relates to a control device of a connector for securing a socket on the connector.

BACKGROUND OF THE INVENTION

A conventional connector 1 for securing a socket (not shown) mounted thereon is disclosed in FIG. 1, and the connector 1 generally includes a axial recess 10 defined in an end of the connector 1 and a first radial hole 11, a radial slot 12 and a second radial hole 13 are respectively defined in the connector 1. A controller 2 is rotatably mounted on the connector 1 and an axle 3 is rotatably extends into the axial recess 10. A spring 15 and a bead 16 are received in the first radial hole 11 and the bead 16 can be engaged with either one of two positioning holes 20, 21 defined in the controller 2. A pin 40 extends through a hole 23 in the controller 2 and is secured to a recess 30 defined radially in the axle 3. A positioning ball 41 is engaged with the second radial hole 13 and located in corresponding to a concavity 31 defined in the axle 3. The concavity 31 includes shallow portion and deeper portion. When rotating the controller 2, the bead 16 is pushed inward and compresses the spring 15, and the pin 40 moves along the radial slot 12. The axle 3 is rotated by the pin 40 and the concavity 31 is rotated till the ball 41 is engaged with the deeper portion of the concavity 31 so that the ball 41 is completely merged into the second radial hole 13. Therefore, a socket (not shown) can be easily removed from or mounted to the end of the connector 1. The controller 2 has to be rotated in reverse direction till the bead 16 is engaged with another positioning hole 21 and the concavity 31 is rotated to push the ball 41 upward by the shallow portion. The ball 41 extends out from the second radial hole 13 and securely position the socket mounted to the end of the connector 1. Furthermore, there are too many parts involved in the conventional connector and controller, and a lot of machining steps are required to manufacture the conventional connector and controller.

The present invention intends to provide a controller that is automatically rotated when the user releases the controller and the automatic-return function reduces steps to operate the controller.

SUMMARY OF THE INVENTION

The present invention relates to a connector for connecting sockets and the connector comprises an elongate body having an axial recess defined in an end thereof so as to rotatably receive an axle therein and a guide hole is defined radially in the body and in communication with the axial recess.

A spring is received in the axial recess and biased between a first end of the axle and an inside of the axial recess. A guide portion is defined in a second end of the axle. A ball is movably engaged with a radial hole defined in the end of the body and operatively in contact with the guide portion.

A controller is rotatably mounted to the body and a pin extends through a hole defined through a wall of the controller and the guide hole and engaged with a receiving hole in the axle. The pin is movable in axial direction of the body.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 5 shows a perspective view, partly removed, of the connector and the controller of the present invention;

FIG. 6 shows that the pin is located at an end of the inclined slot;

FIG. 6-1 shows that an acute angle is clamped between the axis of the inclined slot and a longitudinal axis of the body.

DETAILED DESCRIPTION OF THE PREFERRED EMBODIMENT

Figure 4:
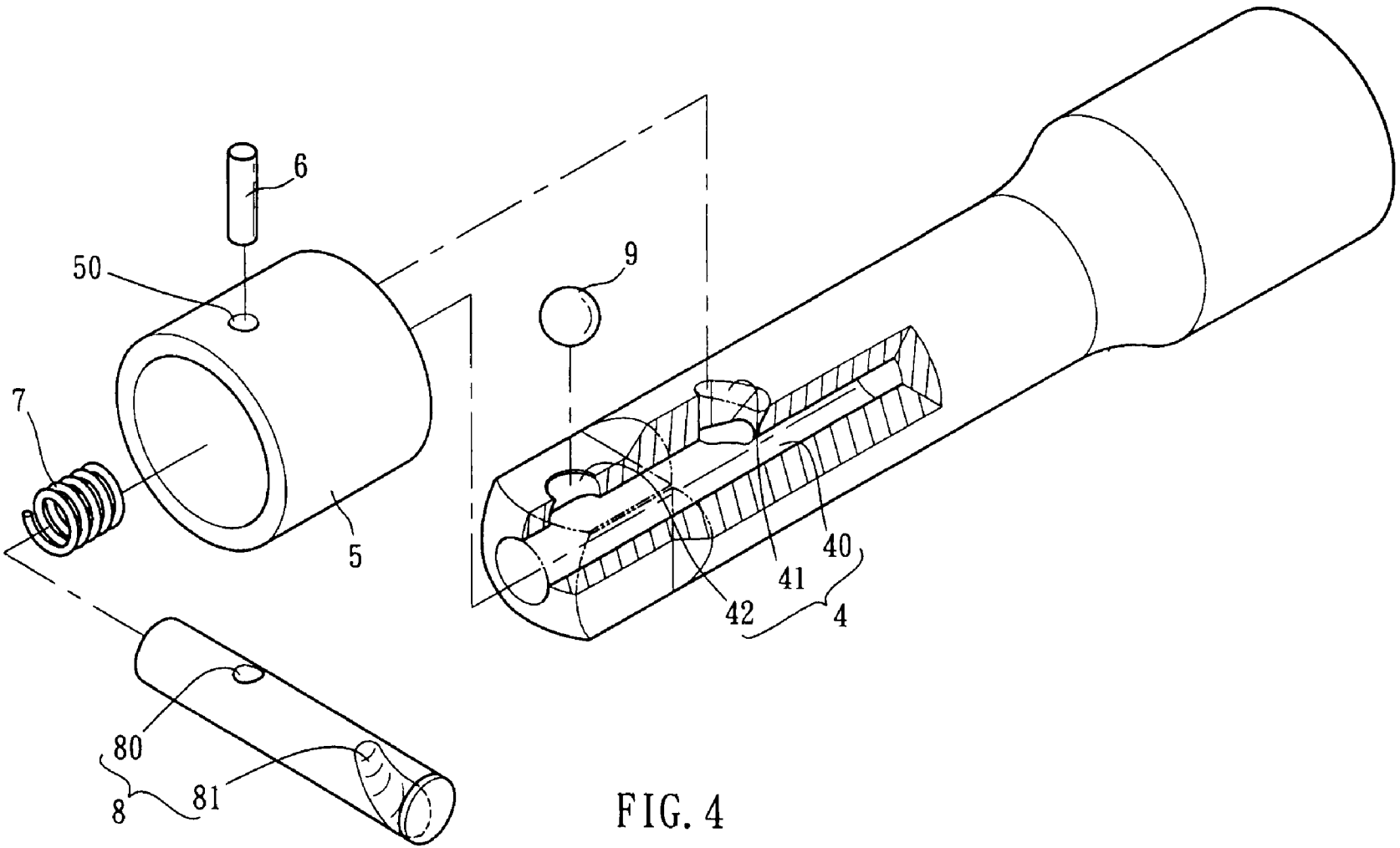
FIG. 4 is an exploded view to show the connector and the controller of the present invention.

Referring to FIGS. 4 to 6, the connector for connecting sockets of the present invention comprises an elongate body 4 having an axial recess 40 defined in an end thereof which generally includes four flat sides and a radial hole 42 is defined in one of the four sides of the end of the body 4 such that a socket (not shown) can be mounted to the end of the body 4 and secured by a ball 9 movably engaged with the radial hole 42. A guide hole 41 is defined radially in the body 4 and in communication with the axial recess 40. The radial hole 42 is also in communication with the axial recess 40.

A spring 7 is received in the axial recess 40 and an axle 8 is rotatably received in the axial recess 40. The spring 7 is biased between a first end of the axle 8 and an inside of the axial recess 40. A guide portion 81 is defined in a second end of the axle 8 and the ball 9 movably engaged with the radial hole 42 is operatively in contact with the guide portion 81. The guide portion 81 can be an inclined surface, a cone-shaped section with different radiuses or a spiral section.

Figure 1:
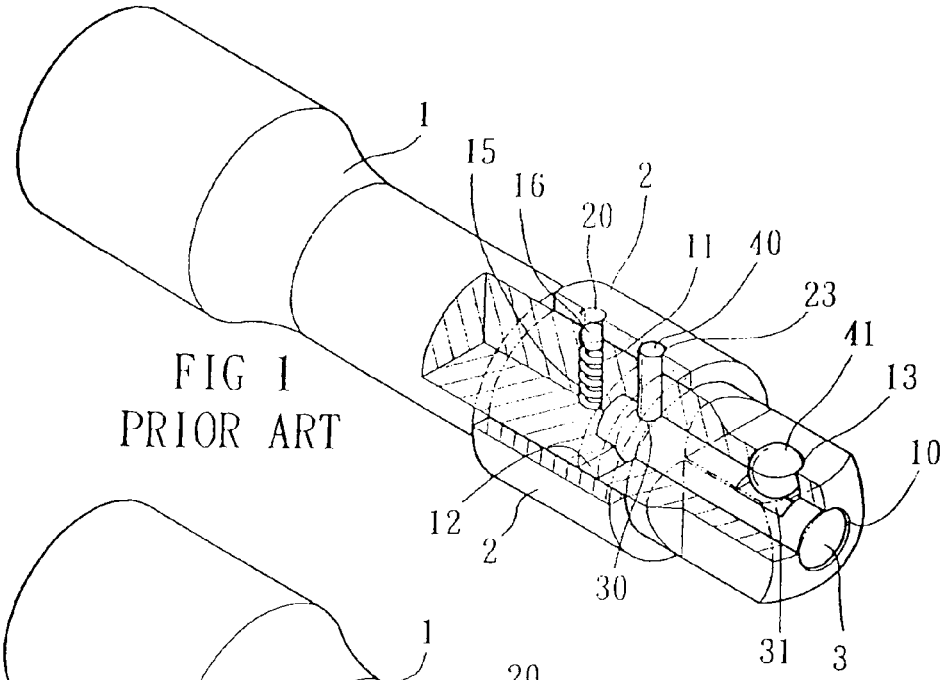
FIG 1 PRIOR ART
FIG. 1 shows a conventional connector with a controller mounted thereto.
Figure 2:
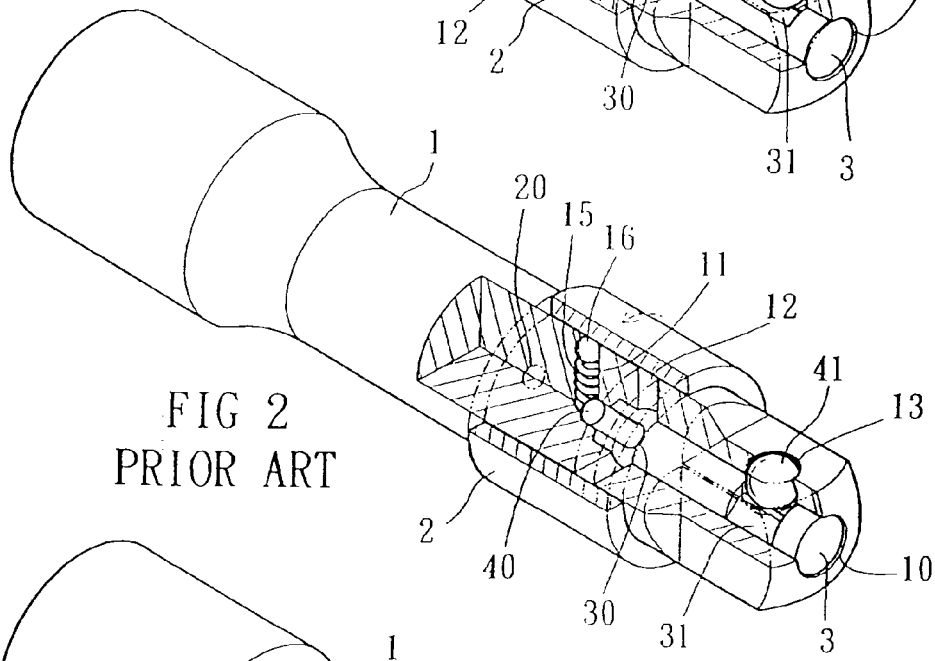
FIG 2 PRIOR ART
FIG. 2 shows that the controller of the conventional connector is rotated relative to the connector.
Figure 3:
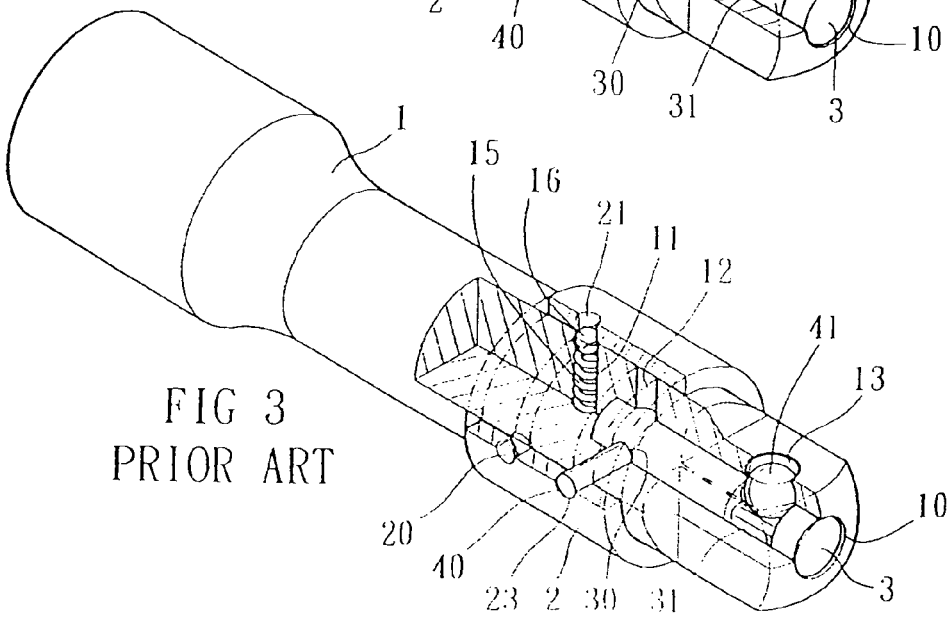
FIG 3 PRIOR ART
FIG. 3 shows that the controller of conventional connector is rotated such that the ball is completely received in the hole of the connector.

A control device includes a tubular controller 5 which is rotatably mounted to the body 4 and a pin 6 extends through a hole 50 defined through a wall of the controller 5 and the guide hole 41 and is engaged with a receiving hole 80 in the axle 8, so that when rotating the controller 5, the axle 8 is rotated therewith. The guide hole 41 is an inclined slot and an acute angle "θ" is clamped between the axis of the inclined slot and a longitudinal axis 40 of the body 4 as shown in FIG. 6-1. By this inclined slot, the pin 6 is movable in axial direction of the body 4. The guide hole 41 can also be a spiral hole. It is noted that when the controller 5 is not rotated relative to the body 4 as disclosed in FIGS. 5 and 6, the spring 7 is not compressed and a part of the ball 9 extends out from the radial hole 42.

Figure 7:
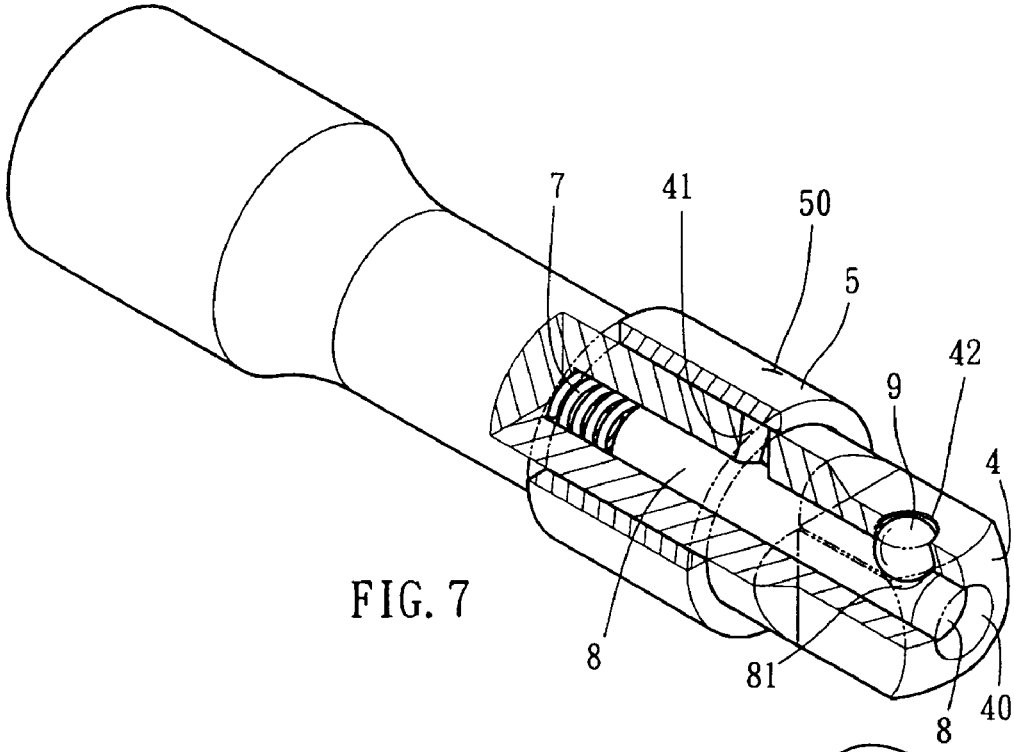
FIGS. 7 and 8 show that the controller is rotated and the pin moves to the other end of the inclined slot, the ball is completely received in the hole.
Figure 8:
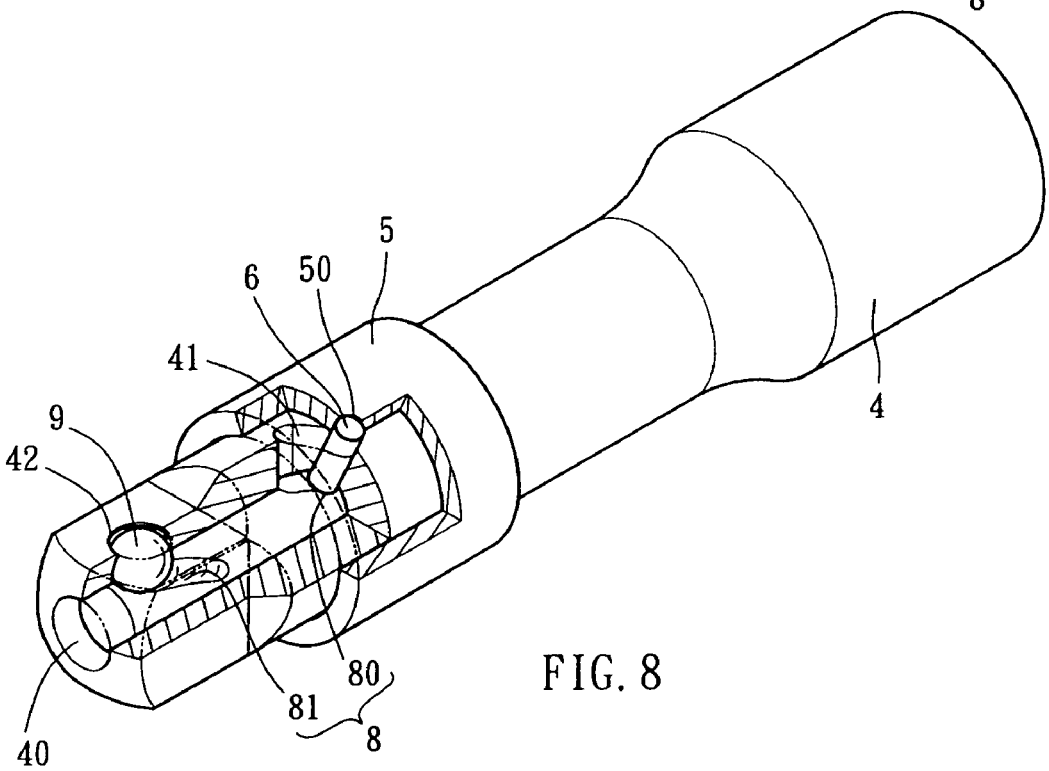

As shown in FIGS. 7 and 8, when rotating the controller 5, the pin 6 moves form one end of the inclined slot as shown in FIG. 6 to the other end of the inclined slot as shown in FIG. 8. This axial movement of the pin 6 moves the axle 8 to compress the spring 7 and the axle 8 simultaneously rotates so as to provide a deeper space to receive the ball 9 which is then completely received in the radial hole 42. The socket (not shown) can be easily mounted to the end of the body 4, or removed from the end of the body 4. When the user releases the controller 5, the spring 5 pushes the axle 8 toward the end of the connector 4 and the pin 6 moves back to the position as disclosed in FIG. 6.

This means that the user needs not to rotate the controller after the socket is mounted to the end of the body 4. Besides, the structure is simplified when compared with the conventional connector and controller, so that the connector and controller of the present invention are easily to be manufactured at lower cost.

While we have shown and described the embodiment in accordance with the present invention, it should be clear to those skilled in the art that further embodiments may be made without departing from the scope of the present invention.

What is claimed is:

1. A connector for sockets, comprising:

an elongate body (4) having an axial recess (40) defined in an end thereof and a guide hole (41) defined radially in the body (4) and being in communication with the axial recess (40), a radial hole (42) defined in the end of the body (4) and being in communication with the axial recess (40);

a spring (7) received in the axial recess (40) and an axle (8) rotatably received in the axial recess (40), the spring (7) biased between a first end of the axle (8) and an inside of the axial recess (40), a guide portion (81) defined in a second end of the axle (8), a ball (9) movably engaged with the radial hole (42) and being operatively in contact with the guide portion (81), and a controller (5) rotatably mounted to the body (4) and a pin (6) extending through a hole (50) defined through a wall of the controller (5) and the guide hole (41) and being engaged with a receiving hole (80) in the axle (8), the pin (6) being movable in axial direction of the body (4).

2. The connector as claimed in claim 1, wherein the guide portion (81) is a spiral section.

3. The connector as claimed in claim 1, wherein the guide hole (41) is spiral hole.

* * * * *